US006066024A

United States Patent [19]

McAvoy, Jr.

[11] Patent Number: 6,066,024

[45] Date of Patent: May 23, 2000

[54] ADJUSTABLE PERFORMANCE YO-YO ENHANCEMENTS

[75] Inventor: John Jerome McAvoy, Jr., Burien, Wash.

[73] Assignee: John J. McAvoy, Jr., Burien, Wash.

[21] Appl. No.: 09/128,886

[22] Filed: Aug. 4, 1998

[51] Int. Cl.[7] ..... A63H 1/30; A63H 1/06

[52] U.S. Cl. ..... 446/250; 440/248

[58] Field of Search ..... 446/250, 251, 446/252, 248, 253, 264, 236

[56] References Cited

U.S. PATENT DOCUMENTS

| | | | |
|---|---|---|---|
| 744,146 | 11/1903 | Wilken | 446/264 |
| 1,779,620 | 10/1930 | Romero | 446/250 |
| 2,629,202 | 2/1953 | Stivers et al. | 446/250 |
| 3,645,037 | 2/1972 | Bginski et al. | 446/264 |
| 3,711,989 | 1/1973 | Nielsen et al. | 446/469 |
| 4,130,962 | 12/1978 | Ennis | 446/250 |
| 4,881,843 | 11/1989 | Randleman | 403/92 |
| 4,895,547 | 1/1990 | Amaral | 446/250 |

FOREIGN PATENT DOCUMENTS

| | | | |
|---|---|---|---|
| 646546 | 8/1962 | Canada | 446/248 |
| 854923 | 11/1970 | Canada | 446/250 |
| 591256 | 1/1934 | Germany | 446/264 |

*Primary Examiner*—D. Neal Muir

[57] ABSTRACT

A yo-yo with the hubs made of either acetal or polycarbonate is disclosed. These materials allow the axle to be press fit into the hubs of the inertial disks with the capability of adjusting the gap between the inertial disks by rotating the two inertial disks relative to each other while pushing or pulling. The high mechanical stability of these materials result in a tight fit between the hub and the axle even after many cycles of gap adjustments and or axle replacements. The performance is improved by adding a smooth sloped transition at the periphery of lapper disks to the larger gap between the two inertial disks. A knot is tied in the tether approximately 2.0 inches from the periphery of the inertial disks. The knot wedges in the sloped transition, which substantially reduces tether slippage. A finger strap is used to attach the tether to the hand.

14 Claims, 3 Drawing Sheets

ADJUSTABLE PERFORMANCE YO-YO ENHANCEMENTS

BACKGROUND OF THE INVENTION

1. Field of the Invention

This invention relates in general to the field of rotating toys. More specifically it relates to the yo-yo.

2. Description of Prior Art

The term yo-yo was derived from the equivalent meaning of come-come in the native language of the Philippines where the toy is thought to have evolved from a weapon in ancient times. Stones with a groove around the periphery have been found in archaeological sites. It is believed that the groove was carved in order to secure a twine or a strip of leather to the stone. A warrior or hunter could throw the stone, quickly recover it and throw it again. Archaeologists have shown that over many years the groove had been made deeper, presumed at first to allow the twine to be all wound within the groove for the convenience of carrying it. The user would not have thrown it from the wound up condition to wound an animal or enemy because this would have resulted in primarily rotational speed of the stone instead of linear speed. The first to have carried a deep groove stone would have had to allow the stone to drop while holding on to the end of the twine to run it out. When the stone reached the end of the twine and rotated back up the twine, the come-come was discovered.

Charles Murray of the Philippine Islands was the first to loop a string around the axle to form a double twisted tether. He did this to avoid the hole drilled through the center of the axle which was commonly used to attach the tether. Murray was granted a patent in 1922. This was the first configuration that allowed the yo-yo to spin freely in the loop at the end of the tether. This free spinning at the end of the tether is referred to as sleeping and is used for performing many trick maneuvers. The yo-yo may be returned to the hand from the sleep condition by a slight jerk on the tether. The phenomenon that takes place here is that following the jerk, the tether becomes momentarily slack and allows the semi tight loop of the tether to wind up on the axle, increasing the frictional drag as more tether is wound around the axle. Pedro Flores, also of the Philippine Islands is given credit for developing and promoting the sleeping yo-yo.

There have been numerous efforts to improve yo-yo performance. A novelty search of prior art relating to the yo-yo discovered the following patents.

| | | Classification | Inventor |
|---|---|---|---|
| U.S. Pat. No. | | | |
| 1,419,402 | 6/1922 | 446/250 | Mosher |
| 1,864,318 | 6/1932 | 446/250 | Powell |
| 2,591,954 | 4/1952 | 446/250 | Madsen |
| 2,629,202 | 3/1953 | 446/250 | Stivers et. al. |
| 2,645,881 | 7/1953 | 446/250 | Frangos |
| 2,676,432 | 4/1954 | 446/250 | Field |
| 2,773,328 | 12/1956 | 446/250 | Fraenkel et. al. |
| 2,891,351 | 6/1959 | 446/250 | Madaras |
| 2,975,547 | 3/1961 | 446/250 | Greve |
| 3,081,578 | 3/1963 | 446/250 | Mosher |
| 3,175,326 | 3/1965 | 446/250 | Isaacson |
| 3,184,885 | 5/1965 | 446/250 | Gibson |
| 3,201,895 | 3/1962 | 446/250 | Stivers |
| 3,256,635 | 6/1966 | 446/250 | Radovan |
| 3,444,644 | 5/1969 | 446/251 | Sayegh |

-continued

| | | Classification | Inventor |
|---|---|---|---|
| 3,805,443 | 4/1974 | 446/250 | Duncan |
| 4,130,962 | 12/1978 | 446/250 | Ennis |
| 4,207,701 | 6/1980 | 446/250 | Kuhn |
| 4,273,275 | 6/1981 | 224/101 | Vadnais |
| 4,290,225 | 9/1981 | 446/250 | MacCarthy |
| 4,318,243 | 3/1982 | 446/250 | MacCarthy |
| 4,332,102 | 6/1982 | 446/250 | Caffrey |
| 4,437,261 | 3/1984 | 446/250 | MacCarthy |
| 4,442,625 | 4/1984 | 446/250 | MacCarthy |
| 4,895,547 | 1/1980 | 446/250 | Amaral |
| 5,017,172 | 5/1991 | 446/250 | Seifert |
| 5,100,361 | 3/1992 | 446/250 | Kuhn |
| 5,127,868 | 7/1992 | 446/250 | Smollar |
| 5,254,027 | 10/1993 | 446/250 | McAvoy |
| 5,389,029 | 2/1995 | 446/250 | McAvoy |
| Foreign Patents | | | |
| 22,401 | 10/1903 | England 446/251 | Weisshappel |
| 15,824 | 4/1904 | Austria 446/251 | Weisshappel |
| 209,288 | 1/1924 | Philippine Islands 446/250 | Murray |
| 504,033 | 4/1936 | England 446/266 | Beresford |

BRIEF SUMMARY OF THE INVENTION

The enhancements to the Adjustable Performance Yo-Yo, U.S. Pat. Nos. 5,254,027 and 5,389,029 and also to conventional yo-yos claimed herein provide performance improvements, allow easy assembly of the axle and body halves, tether gap adjustment and axle replacement.

The performance of the adjustable performance yo-yos is improved by adding a smooth slopped transition from the periphery of the lapper disks to the larger gap between the yo-yo halves. A knot is tied in the tether approximately 2.0 inches from the periphery of the yo-yo. The knot wedges in the smooth slopped transition following the initial spiral wrap of the tether by the lapper disks. The wedging of the knot substantially reduces tether slippage. The spin torque exerted by the tether during the down trust will act for nearly the whole length of the tether resulting in higher spin speeds. A series of closely spaced knots, a thicker section of tether formed by weaving or a rubber bead fixed to the tether are also claimed.

Another innovative feature is the hub which is made of either acetal or polycarbonate which have a very high mechanical stability for a soft material. These materials allows a small diameter axle to be press fit into the hubs of the yo-yo with the capability of adjusting the gap between the two inertial disks by rotating the two inertial disks relative to each other while pushing or pulling. The frictional reaction force in the axial direction is vectored circumferentially by the twisting motion allowing axial displacement of the inertial disks on the axle by the force of hands. The compacted tether between the two inertial disks during the down thrust and return from the sleep condition create a large spreading force between the two inertial disks. The axial friction reaction force remains sufficiently high during use because the tether drag torque on the two inertial disks is nearly equivalent on both sides so as not to cause any relative rotation between the two inertial disks. The high mechanical stability of the acetal or polycarbonate material result in a tight fit between the hub and the axle even after many cycles of gap adjustments and or axle replacements. The advantage of a small diameter axle is low frictional drag torque between the tether and the axle allowing for longer sleep times to perform tricks. The drag torque is directly proportional to the axle diameter. Yo-yo prototypes with acetal hubs successfully retained 1/16 inch diameter music wire for an axle. The disadvantage of a small diameter axle is accidental bending. The hub material of this innovation allows the axle to be easily replaced. The inertial disks may be made of plastics, typically used for low cost injection molding, wood or metal. The acetal or polycarbonate hubs are press fit or bonded into the body halves.

Other innovations are a finger strap and finger mitt to attach the tether to the hand and a stand for displaying yo-yos.

DETAILED DESCRIPTION OF THE INVENTION

Figure 1:
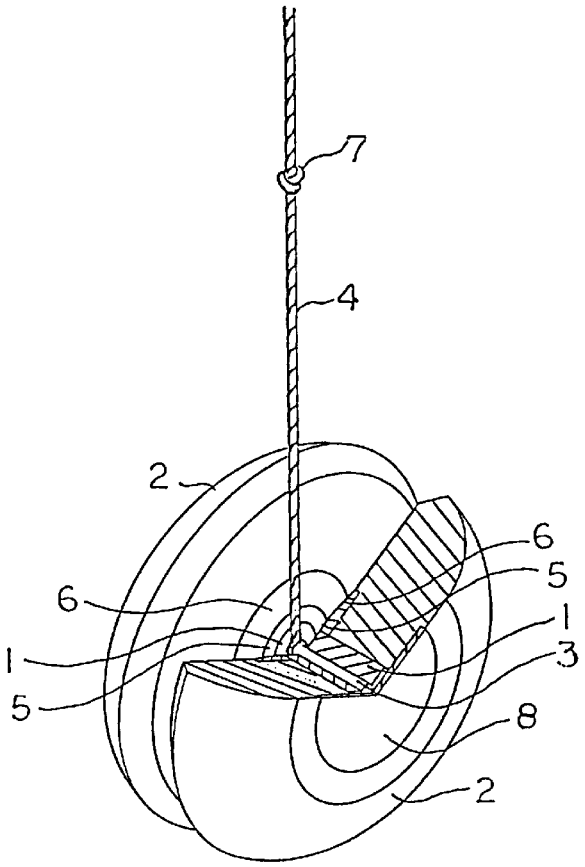
FIG. 1 is an isometric section view of the adjustable performance yo-yo showing the acetal or polycarbonate hubs, lapper disks, smooth sloped transitions, axle and tether with the knot.

Referring now to FIG. 1, an isometric section view of the present invention is shown. The hubs 1, are made of a either polycarbonate or acetal which have a very high mechanical stability for a soft material. The hubs 1 are press fit or bonded into the inertial disks 2. The hubs 1 may be grooved circumferentially and longitudinally on the outer surface to provide a grip for an epoxy bond. The inertial disks 2 may be made of plastics typically used for low cost injection molding, wood, or metal. The acetal or polycarbonate material of the hubs 1 allow for a small diameter axle 3 to be press fit into the hubs 1 of the inertial disks 2 with the capability of adjusting the gap between the inertial disks 2 by rotating the inertial disks 2 relative to each other while pushing or pulling. The frictional reaction force between the hubs 1 and the axle 3 in the axial direction is vectored circumferentially by the twisting motion. This effect allows the gap between the two inertial disks 2 to be adjusted with the force of hand. The press fit of the axle 3 into the hub 1 must be firm. The tether 4 compacted between the two inertial disks 2 of a yo-yo during the down thrust and return from the sleep condition create a large spreading force between the inertial disks 2. The axial friction reaction force between the axle 3 and the hubs 1 remains sufficiently high during use because the tether frictional drag torque on the two inertial disks 2 is equivalent so as not to cause any relative rotation between the two inertial disks 2. The high mechanical stability of the acetal and polycarbonate hub 1 materials result in a tight fit between the hub 1 and the axle 3 even after many cycles of gap adjustments and or axle 2 replacements. The advantage of a small diameter axle 3 is low frictional drag torque between the tether 4 an the axle 3 which allows for a longer sleep time to perform tricks. The drag torque is directly proportional to the axle 3 diameter. Prototype yo-yos have been successfully built using 1/16 inch diameter music wire for the axle 3. The disadvantage of a small diameter axle 3 is accidental bending. The hub 1 material of this innovation allows the axle 3 to be replaced without a significant loss of the firmness of the press fit.

The lapper disk 5 surfaces, consisting of the face of the hubs 1 and the flat region beyond comprising a flat smooth surface of approximately 0.5 inches in diameter, make skimming contact with the tether 4 during the sleep condition. The yo-yo is returned to the hand from the sleep condition by creating slack in the tether 4 by a slight jerk of the tether 4. The slack tether 4 is lapped up in a spiral between the two lapper disks 5 to initiate the rewinding of the tether 4 between the two inertial disks 2. This process is patented by the inventor and explained in detail in U.S. Pat. Nos. 5,254,027 and 5,389,029. There is substantial slippage of the tether 4 during the recovery from the sleep condition until about one third of the tether 4 is wound around the axle 3 and becomes compacted between the two inertial disks 2. This tether slippage is typical of all yo-yos. This tether slippage characteristic during recovery from the sleep condition is not as critical as it is during the down thrust of the yo-yo where it is desirable to achieve high spin speeds. The tether tension, during the down thrust of the yo-yo induces a torque on the yo-yo as the tether unwinds from the axle, causing angular acceleration. The tether tension and thus angular acceleration is reduced during the down thrust at the end of the tether where slippage occurs. The sloped transitions 6 from the periphery of the flat smooth lapper disks 5 to the body 2 which is disclosed herein as a performance enhancement. The knot 7, tied in the tether 4 approximately two inches from the periphery of the bodies 2, wedges in the sloped transition 6 following the spiral lapping up of the first three inches of the tether 4 by the lapper disks 5 during the return to the hand from the sleep condition. The hub caps 8 cover the hubs 1 and the axle 3 and prevent the axle 3 from extending out of the hubs 1.

Figure 2:
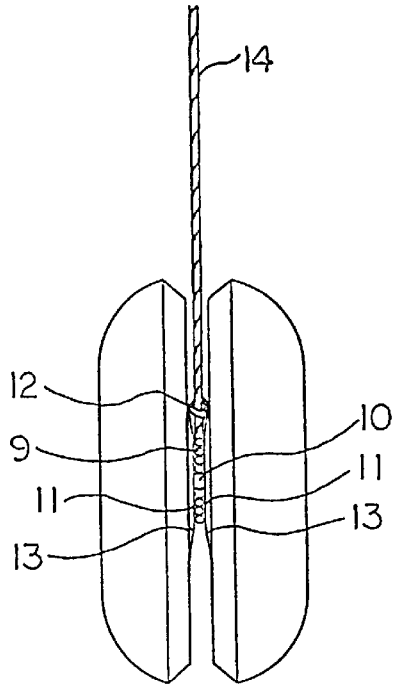
FIG. 2 is a frontal view of the adjustable performance yo-yo showing the cross section of the tether spiraled between the lapper disks and the knot wedged between the smooth sloped transitions.

Referring to FIG. 2, a frontal view of the adjustable performance yo-yo is shown with the cross section of the first three inches of tether 9 spiraled around the axle 10 between the two flat smooth lapper disks 11 surfaces, with the knot 12 wedged in the smooth sloped transitions 13. A section of the remaining tether 14 is shown extending above. Prototype yo-yos with the sloped transition 13 and the knot 12 snap back to the hand from the sleep condition. No slippage of the tether is noticed. What is more important, is that the sleep time of this prototype yo-yo was increased from 50 seconds to 62 seconds. This is a 24 percent improvement in sleep time. The official existing world record for fixed axle yo-yos is 52 seconds. The wedging of the knot 12 in the sloped transition 13 eliminates tether 14 slippage and allows angular acceleration of the yo-yo for nearly the whole length of the tether 14 during the down thrust. Existing yo-yo technology typically employ radial ribs, emanating from the axle or bearing interface, to increase friction on the tether. The height of the ribs decrease with the radius providing a sloped transition to the smooth surface beyond as shown by the ribs 45 in FIG. 1 of U.S. Pat. No. 4,895,547 to Amaral. Slippage still occurs in these yo-yos because there is no interference fit between the tether and the ribbed surface. These ribbed surface scuff the tether and reduce tether life. Referring back to FIG. 1, in the present invention, the smooth sloped transition 6 is outside of the lapper disks 5 which initiate tether 4 wind up. Three to three and a half inches of tether is coiled up in the lapper disks 5 before the knot 7 wedges in the smooth sloped transitions 6. The knot 7 being two inches away from the periphery of the bodies 2 also allows space for the tether 4 to be untwisted and removed from the inertial disks 2 and axle 3 assembly for waxing. In existing fixed axle yo-yo technology, the friction between the axle and semi tight loop of the tether is used to initiate tether wind up from the sleep condition. As explained by Stivers in U.S. Pat. No. 3,201, 895 Column 4, Line 59: "Such tricks, however, require selectively applied friction between the inner surfaces of the discs and the string. A common disadvantage encountered in accomplishing such tricks is in that either too much, or to little friction is provided between the disc surfaces and/or the axle, and the string." Stivers also states in Column 5, Line 4: "---the surfaces provide enough friction when brought into engagement with the string (as by the build up of thickness when the string is compactly wound upon itself) to cause the string to be rewound on the body of the yo-yo." The key words here are "build up" and "brought into engagement". The string spreads laterally in the gap to engage the annular area 50 which are roughened by etching or frosted in Stivers presentation. The tether gap between the roughened or ribbed regions of existing yo-yos in some cases may be too large to have an interference fit with a tether knot.

Figure 3:
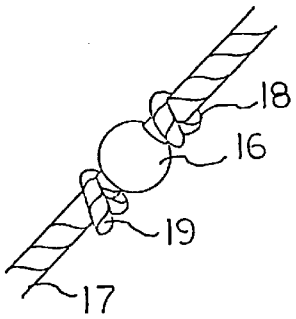
FIG. 3 shows a rubber bead fixed to a tether with adjacent knots.
Figure 4:
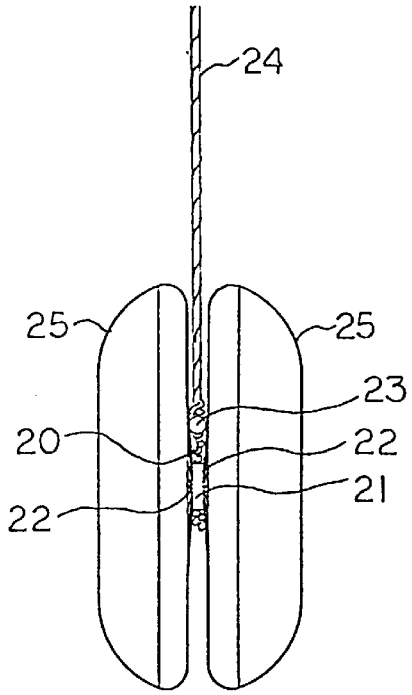
FIG. 4 is a frontal view of a conventional yo-yo showing the cross section of the tether wrapped around the axle with the rubber bead wedged between the radial ribs.
Figure 6:
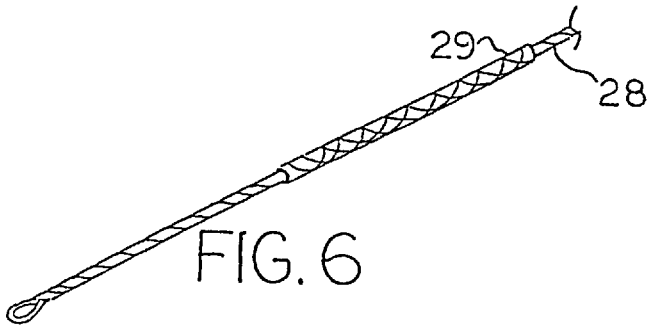
FIG. 6 shows a tether with a woven section increasing the tether diameter.

Referring to FIG. 3, a rubber bead 16 fixed in place on the tether 17 by a knot 18 above and a knot 19 below as shown. The rubber bead 16 diameter is chosen to provide an interference fit in the smooth sloped transition 6 of the present invention or in the ribbed region 22 of existing technology yo-yos as shown in FIG. 4. Referring to FIG. 4, the cross section of the first few inches of tether 20 is shown wrapped around the axle 21 with a build up between the ribbed regions 22 and with the rubber bead 23 wedged between the ribbed regions 22. The remaining tether 24 is shown extending above between the inertial disks 25. The rubber bead will provide higher friction than a knot. In FIG. 4 and FIG. 6 of U.S. Pat. No. 3,175,326 to Isaacson, slopped interior surfaces of the members 43, 44, 83 and 84 are shown. These slopped surfaces play no functional means of increasing friction of the tether (convolutions 54 of the suspending string). The purpose is undoubtedly to create a wider gap at the periphery for performing tricks to land a sleeping yo-yo off a loop on to the tether which is a common practice. Isaacson does claim the wedged shaped groove 16 in the outer race of the bearing shown in FIG. 1. In Column 2, Line 15 it is stated that "the suspension string is formed with a single loop at its lower end which encompasses the outer periphery of the bearing 25*d* ( should be 25*a*) (see FIG. 3 ) or the outer periphery of the wedge ring 12." It is obvious that the string loop does not slip rotationally in the wedge ring 16. The bearing rotates. The function of wedge is to allow a build up of string during the recovery from the sleep condition to spread out in the groove and wedge under the inertia member 23*a* and 24*a* as shown in FIG. 3. This wedging of the string between the outer race of the bearing and the inertia members effectively brakes the bearing. The wedge ring 16 has no functional relationship to the wedging of the knot 7 and the sloped transition 6 shown in FIG. 1 of the present invention. In the present invention, the tether slips in the sloped transition 6 until the knot 7 enters via interference fit and becomes wedged. In the Philippine Island Patent No. 209,288 to Charles Murray, Line 72, knotting the string at intervals to prevent the string from untwisting is discussed. These knots are not used to create an interference fit of the string with any part of the yo-yo.

Figure 5:
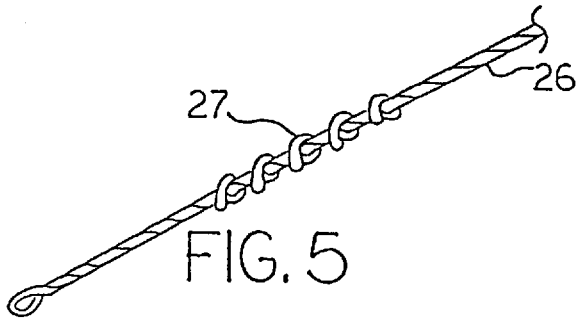
FIG. 5 shows a tether with a series of knots.
Figure 7:
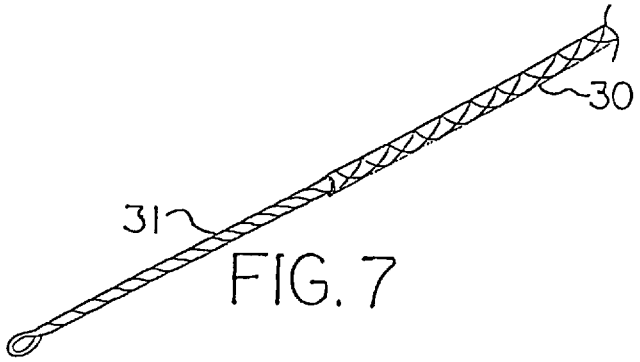
FIG. 7 shows a larger diameter tether with a small diameter leader.

Three variations of a tether are shown in FIG. 5 through FIG. 7 to effect the wedging of the tether in the sloped transition or ribbed regions of a yo-yo for the purpose of inducing higher torque on a yo-yo during the down thrust. Referring to FIG. 5, a tether 26 with a series of knots 27 is shown. Referring to FIG. 6, a tether 28 with woven section 29 of larger diameter is shown. Referring to FIG. 7, a large diameter tether 30 with a standard smaller diameter looped leader 31 is shown. The larger diameter tether 30 has the additional benefit of filling up the outer region of the gap between the yo-yo bodies such that during the down thrust of the yo-yo, there will be a larger moment arm, thus inducing higher torque, higher spin rate and longer sleep time.

Figure 8:
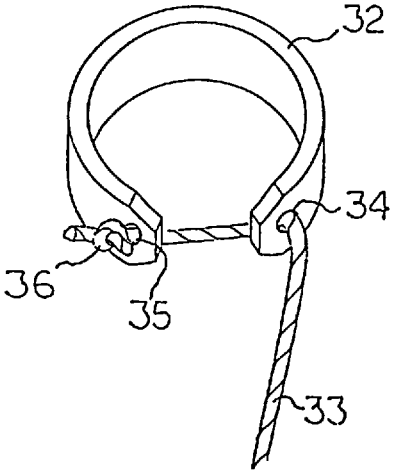
FIG. 8 shows an isometric view of the finger strap with tether and knotted end.

Referring to FIG. 8, an isometric view of a finger strap 32 is shown. The tether 33 is inserted through the holes 34 and 35. A securing knot 36 is tied at the end of the tether 33 outside of hole 35. The hole 34 slips on the tether 33 such that the strap 32 acts a noose and cinches up when the tether 33 is tensioned. The finger strap 32 may be made of leather or a synthetic equivalent. This is an improvement over the running noose formed by the hitch shown in FIG. 6 of U.S. Pat. No. 5,254,027 to this same inventor. In U.S. Patent to Smollar, an o-ring is used to form a running noose on the end of the tether. This tether also runs over the top of the finger. The finger strap 32 of the present invention has the same cinching characteristics as the hitch or the o-ring, but keeps the narrow cinching painful string off the finger. U.S. Pat. No. , 1,864,318 to Powell claims an adjustable ring with a swivel connection for attachment to a string. U.S. Pat. No. 4,273,275 to Vadnais also claims a ring with a swivel connection for attachment to a string. Vadnais' ring is made of velcro, allowing an adjustable fit to the finger. Neither of these inventions cinch to the finger by tensioning of the tether as does the present invention.

Figure 9:
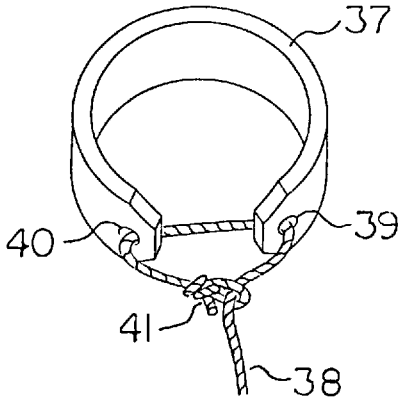
FIG. 9 shows an isometric view of the finger strap with tether and end noose.

Referring to FIG. 9, an isometric view of the finger strap 37 with an alternate rigging of the tether 38 is shown. The tether 38 passes rough the holes 39 and 40 with the running nose 41 back over the tether 38.

Figure 10:
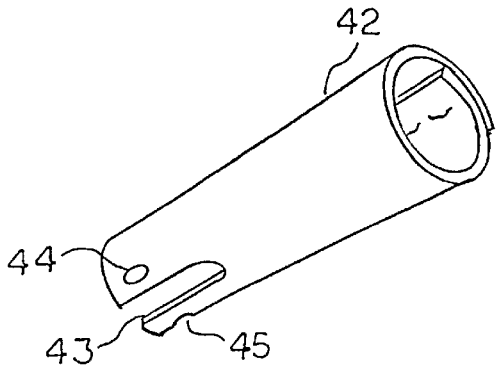
FIG. 10 shows an isometric view of the finger mitt with cleft end.

Referring to FIG. 10, an isometric view of the finger mitt 42 is shown. The finger tip end has a cleft 43 with holes 44 and 45 for rigging the tether as shown in either of FIGS. 8 or 9. The cleft 43 allows the end of the mitt 42 to be cinched up on the finger tip just inside of the first knuckle of the middle finger. The purpose of the finger mitt 42 is to cushion the finger from the impact of the yo-yo returning to the hand from the sleep condition. High performance yo-yos as disclosed herein may return to the hand at the same speed at which they are thrown down.

Figure 11:
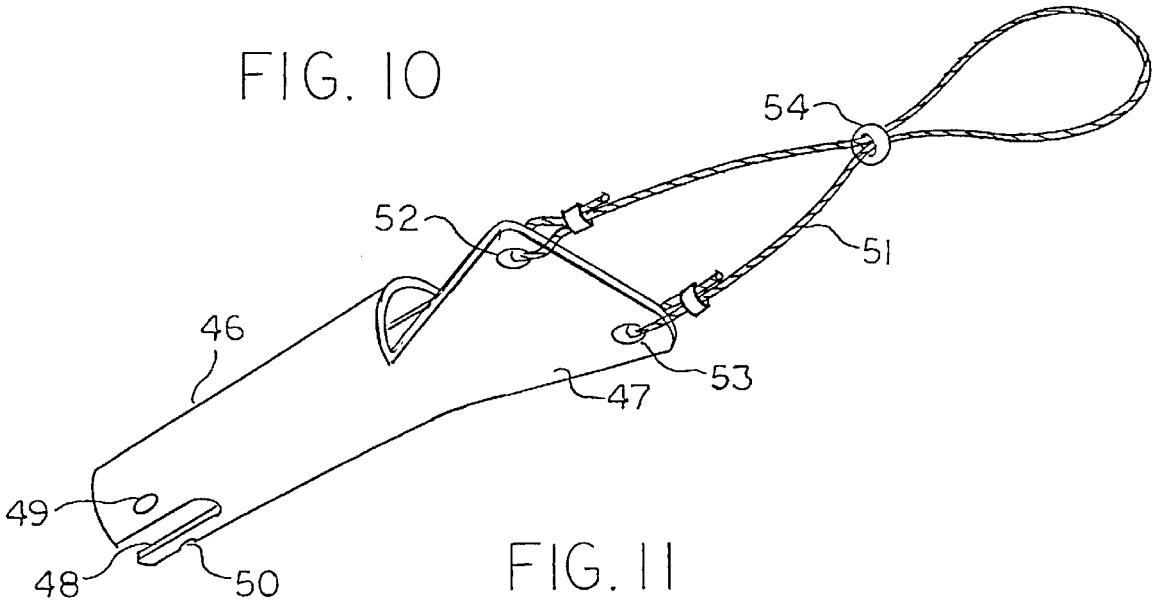
FIG. 11 shows an isometric view of the finger mitt with palm pad and wrist lanyard.

Referring to FIG. 11, an isometric view of the finger mitt 46 with a palm pad 47 is shown. The finger tip end has a cleft 48 with holes 49 and 50 for rigging the tether as shown in either of FIGS. 8 or 9. A lanyard 51 may be used to tension the palm pad 47 to the wrist. The lanyard 51 is attached to the holes 52 and 53. The bead 54 is serves to cinch the lanyard 51 to the wrist. The lanyard may be made of an elastic or inelastic material.

Figure 12:
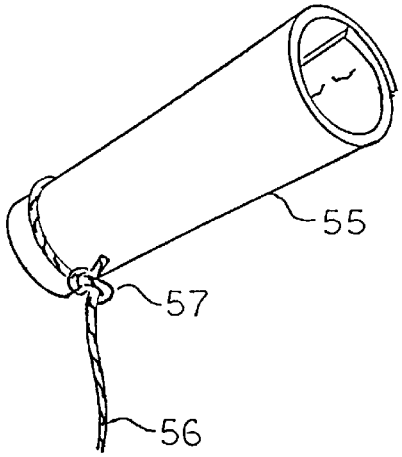
FIG. 12 shows an isometric view of the finger mitt with the tether noose over the outer periphery of the mitt.

Referring to FIG. 12, an isometric view of the finger mitt 55 with the tether 56 having the standard running noose 57 looped over the outer periphery of the mitt in the region of the first knuckle of the middle finger. The tether noose will cinch the mitt on the finger. The finger mitts of FIGS. 10 through 12 may be made of leather or a synthetic equivalent and stitched to form different sizes. The mitts may also be made of an elastic material to provide a one size fit for all.

Figure 13:
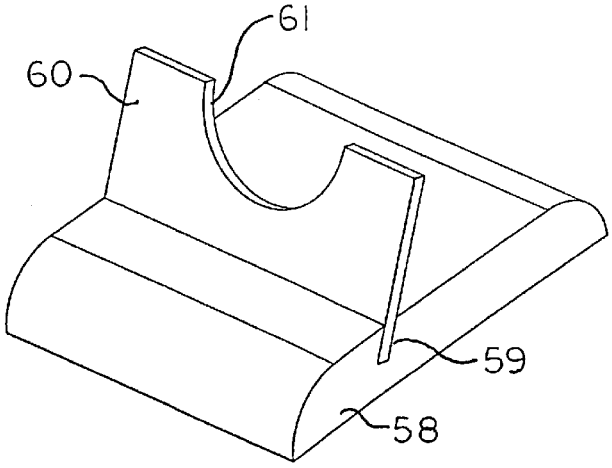
FIG. 13 shows an isometric view of the yo-yo display stand.

Referring to FIG. 13, an isometric view of a yo-yo display stand is shown. The base 58 has a slot 59 retaining a flat plate 60. The flat plate 60 has an arc cut out 61 having a diameter slightly larger than the diameter of a tether wound between the inertial disks of a yo-yo. The flat plate 60 has a thickness less than the gap between the inertial disks of a yo-yo. The two inertial disks of a yo-yo straddle the flat plate 60 with the wound up tether nestled in the arc cut out 61. The base 58 and the flat plate 60 may be made out of any combination of wood, plastic or metal. The cross section of the base 58 and the flat plate 60 may be an integrated extrusion of plastic or metal. The length of the display stand may be made greater to allow for multiple arc cut outs 61 to display a multiple of yo-yos.

What I claim is:

1. An adjustable performance yo-yo comprising in combination:

a. axle means, b. string looped about a central portion of said axle means defining a twist spiraled tether means, c. two inertial disks each having an annular region of radial ribs means and a hub means made of either acetal or polycarbonate material means press fit on each end of said axle means said hub acetal or polycarbonate material means allowing adjustment of space between said annular region of radial ribs means by pushing or pulling by the hands with a relative twist of the two said inertial disks.

2. A yo-yo as claimed in claim 1 having a knot means tied in said twisted spiraled tether means such that prior to completion of winding of said twisted spiraled tether means within said annular region of radial rib means said knot means wedges in said annular region of radial rib means.

3. A yo-yo as claimed in claim 1 having a series of closely space knots means tied in said twisted spiraled tether means such that prior to completion of winding of said twisted spiraled tether means within said annular region of radial rib means said series of closely spaced knot means wedges in said annular region of radial rib means.

4. A yo-yo as claimed in claim 1 having an elastomeric bead means fixed on said twisted spiraled tether means such that prior to completion of winding of said twisted spiraled tether means within said annular region of radial rib means said elastomeric bead means wedges in said annular region of radial rib means.

5. A yo-yo as claimed in claim 1 having a section of larger diameter tether means located on said twisted spiraled tether means such that prior to completion of winding of said twisted spiraled tether means within said annular region of radial rib means said section of larger diameter tether means wedges in said annular region of radial rib means.

6. A yo-yo as claimed in claim 1 having a large diameter tether means having smaller diameter leader means having looped end means about said axle means with said leader means of length such that prior to completion of said smaller diameter leader means wound within said annular region of radial rib means said larger diameter tether means wedges in said annular region of radial rib means and is wound in and more fully fills outer region between said two inertial disks.

7. An adjustable performance yo-yo comprising in combination:

a. axle means, b. string looped about a central portion of said axle means defining a twisted spiraled tether means, c. two inertial disks each having a flat smooth annular surface means consisting in part of a hub means made of either acetal or polycarbonate material means press fit on each end of said axle means, said hub means made of acetal or polycarbonate material means allowing adjustment of space between said flat smooth annular surface means defining a first gap between said flat smooth annular surface means by pushing or pulling by the hands with a relative twist of the two said inertial disks, d. said flat smooth annular surface means on facing surfaces of each of said two inertial disks whereby skimming contact with said twisted spiraled tether means extending above said axle in first said gap is effected by said adjustment of space, e. second surface means on said inertial disks extending radially beyond said flat smooth annular surface means, whereby said gap between the said two inertial disks at said second surface means forms a second gap which is larger than said first gap to inhibit further said skimming contact with said twisted spiraled tether means and wherein said twisted spiraled tether means may be wound in said second gap beyond said flat smooth annular surface means.

8. An adjustable performance yo-yo as claimed in claim 1 and in addition comprising in combination:

a. an annular smooth sloped transition means from the said smooth flat annular surface means to the said second surface means radially beyond, b. a knot means tied in said twisted spiraled tether means such that at completion of winding of said twisted spiraled tether means within said fist gap said knot means wedges in said annular smooth sloped transition means.

9. A yo-yo as claimed in claim 1 and in addition comprising in combination:

a. an annular smooth sloped transition means from the said smooth flat annular surface means to the said second surface means radially beyond, b. a series of closely spaced knots means tied in said twisted spiraled tether means such that at completion of winding of said twisted spiraled tether means within said first gap said closely spaced series of knots means wedges in said annular smooth sloped transition means.

10. A yo-yo as claimed in claim 1 and in addition comprising in combination:

a. an annular smooth sloped transition means from the said smooth flat annular surface means to the said second surface means radially beyond, b. an elastomeric bead means fixed on said twisted spiraled tether means such that at completion of winding of said twisted spiraled tether means within said first gap means said elastomeric bead means wedges in said annular smooth sloped transition means.

11. A yo-yo as claimed in claim 1 and in addition comprising in combination:

a. an annular smooth sloped transition means from the said smooth flat annular surface means to the said second surface means radially beyond, b. a tether having a section of larger diameter means such that at completion of winding of said twisted spiraled tether means within said first gap said section of larger diameter tether means wedges in said annular smooth sloped transition means.

12. A yo-yo as claimed in claim 1 and in addition comprising in combination:

a. an annular smooth sloped transition means from the said smooth flat annular surface means to the said second surface means radially beyond, b. a large diameter tether means having smaller diameter leader means having looped end means about said axle with said leader means of length such that at completion of said smaller diameter leader means wound within said first gap said larger diameter means wedges in said annular smooth sloped transition means and is wound in and more fully fills said second gap means.

13. An adjustable performance yo-yo as claimed in claim 1, wherein said tether means end opposite said axle means is attached to a strap having a cleft means with said tether means end laced through holes adjacent to said cleft means, whereby tensioning said tether means cinches said strap.

14. An adjustable performance yo-yo as claimed in claim 1, wherein said tether means end opposite said axle means is attached to a finger mitt having a cleft means on end of said mitt with said tether means end laced through holes adjacent to said cleft means, whereby tensioning said tether means cinches said finger mitt in a region of said cleft.

* * * * *